US008986168B2

(12) United States Patent
Chen

(10) Patent No.: US 8,986,168 B2
(45) Date of Patent: Mar. 24, 2015

(54) FITNESS EQUIPMENT FOR USE IN HIP LIFT AND TREADING

(71) Applicant: St Life Co., Ltd., Changhua County (TW)

(72) Inventor: Jue-Yao Chen, Taichung (TW)

(73) Assignee: St. Life Co., Ltd., Changhua County (TW)

( * ) Notice: Subject to any disclaimer, the term of this patent is extended or adjusted under 35 U.S.C. 154(b) by 0 days.

(21) Appl. No.: 13/911,119

(22) Filed: Jun. 6, 2013

(65) Prior Publication Data

US 2014/0364279 A1 Dec. 11, 2014

(51) Int. Cl.
*A63B 22/06* (2006.01)
*A63B 23/04* (2006.01)

(52) U.S. Cl.
CPC ..... *A63B 23/04* (2013.01)
USPC ..... 482/52; 601/23; 601/27; 601/29

(58) Field of Classification Search
CPC ..... A63B 22/0664; A63B 22/16
USPC ..... 482/52; 601/23, 27, 29, 31, 32, 33, 34, 601/35, 36
See application file for complete search history.

(56) References Cited

U.S. PATENT DOCUMENTS

| | | | | |
|---|---|---|---|---|
| 3,765,407 | A * | 10/1973 | Prince | 601/90 |
| 3,911,907 | A * | 10/1975 | Smith, Jr. | 482/1 |
| 5,271,416 | A * | 12/1993 | Lepley | 600/595 |
| 2007/0299373 | A1 * | 12/2007 | Chen | 601/30 |

* cited by examiner

*Primary Examiner* — Loan H Thanh
*Assistant Examiner* — Rae Fischer
(74) *Attorney, Agent, or Firm* — Alan D. Kamrath; Kamrath IP Lawfirm, P.A.

(57) ABSTRACT

A fitness equipment for use in hip lift and treading, including a casing. The casing has therein a power source. The power source is a motor. A center axle of the motor rotates to drive a transmission shaft. The transmission shaft drives first and second independent shafts to rotate. Rotational mechanical energy of the first and second independent shafts is transmitted to first, second, third and fourth eccentric blocks, such that first, second, third and fourth spindles, first and second U-shaped supports, and first and second rests together move vertically and alternately along an elliptic track so as for a user standing on the first and second rests to tread and for the user sitting on the first and second rests to perform hip lift.

12 Claims, 8 Drawing Sheets

FITNESS EQUIPMENT FOR USE IN HIP LIFT AND TREADING

BACKGROUND OF THE INVENTION

1. Technical Field

The present invention relates to fitness equipments, and more particularly, to a fitness equipment for use in hip lift and treading, wherein the fitness equipment is characterized by an eccentric driving mechanism whereby two rests are driven to move vertically and alternately along an elliptic track so as for a user to lift his or her hips or tread, thereby allowing the user to work the lower limbs or hips fully and effectively.

2. Description of Related Art

There is a wide variety of fitness equipments, including fitness bikes, treadmills, weight lifting devices, and pull exercisers. However, despite the good selection of fitness equipments, fitness equipments for use in hip lift are unavailable. Furthermore, designed for intense workouts, the aforesaid fitness equipments are not suitable for persons looking for moderate workouts. At present, moderate workout equipments are not commercially available.

SUMMARY OF THE INVENTION

It is an objective of the present invention to provide a fitness equipment for use in hip lift and treading, characterized in that: a center axle of a motor rotates to drive the first and second independent shafts to rotate, allowing rotational mechanical energy of the first and second independent shafts to be transmitted to first, second, third and fourth eccentric blocks, such that first, second, third and fourth spindles, first and second U-shaped supports, and first and second rests together move vertically and alternately along an elliptic track so as for a user standing on the first and second rests to tread and for the user sitting on the first and second rests to perform hip lift.

In order to achieve the above and other objectives, the present invention provides a fitness equipment for use in hip lift and treading. The fitness equipment comprises a casing. The casing has therein a power source. The power source is a motor. A center axle of the motor rotates to drive a transmission shaft. The transmission shaft drives first and second independent shafts to rotate. The rotational mechanical energy of the first and second independent shafts is transmitted to first, second, third and fourth eccentric blocks, such that first, second, third and fourth spindles, first and second U-shaped supports, and first and second rests together move vertically and alternately along an elliptic track to thereby enable a user standing on the first and second rests to tread and the user sitting on the first and second rests to perform hip lift.

The technical solution, means, and advantages of the present invention are described hereunder with reference to a preferred embodiment and accompanying drawings. Hence, persons skilled in the art can gain insight into the objectives, structures, and features of the fitness equipment of the present invention.

DETAILED DESCRIPTION OF THE EMBODIMENTS OF THE INVENTION

Figure 1:
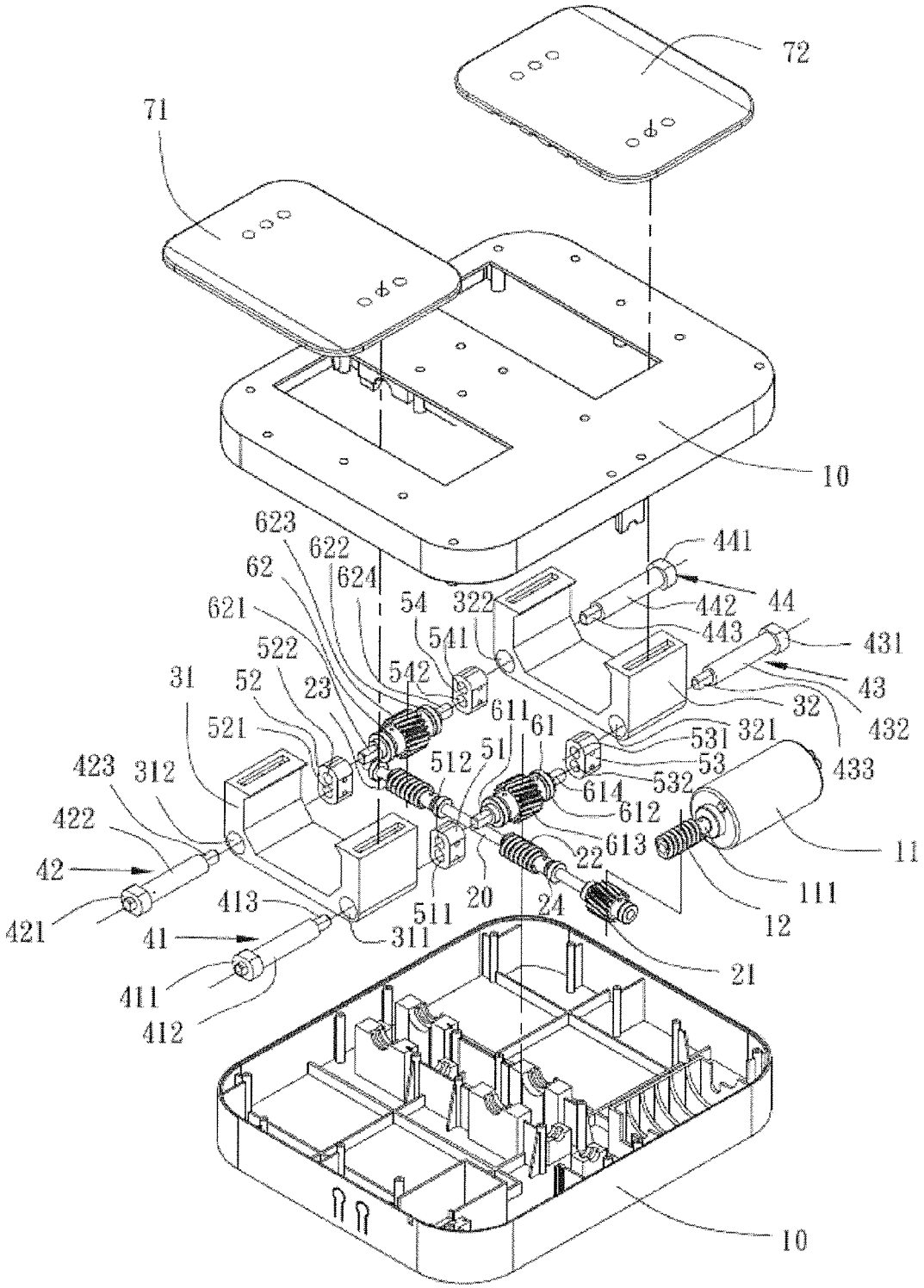
FIG. 1 is an exploded view of a fitness equipment according to an embodiment of the present invention.
Figure 2:
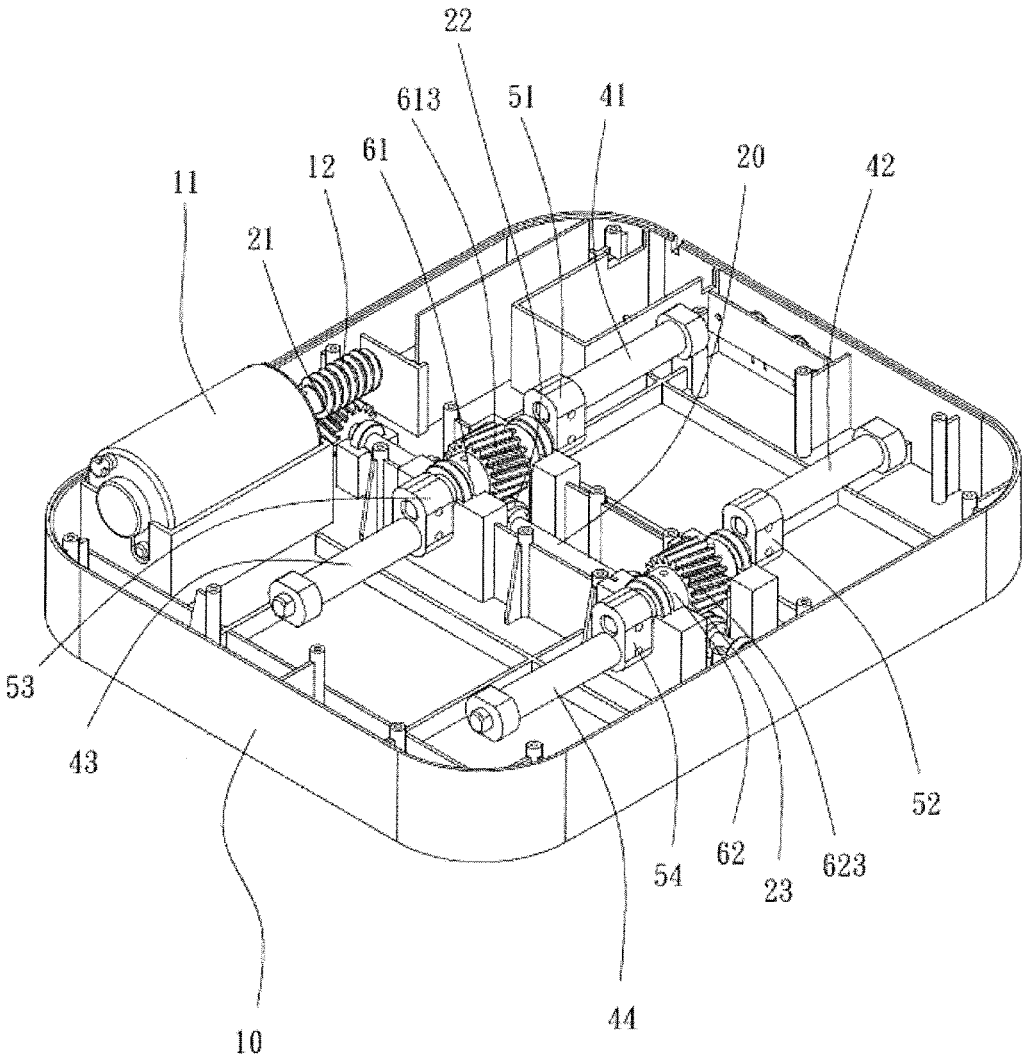
FIG. 2 is a cutaway view of transmission-related elements of the fitness equipment of the present invention.
Figure 3:
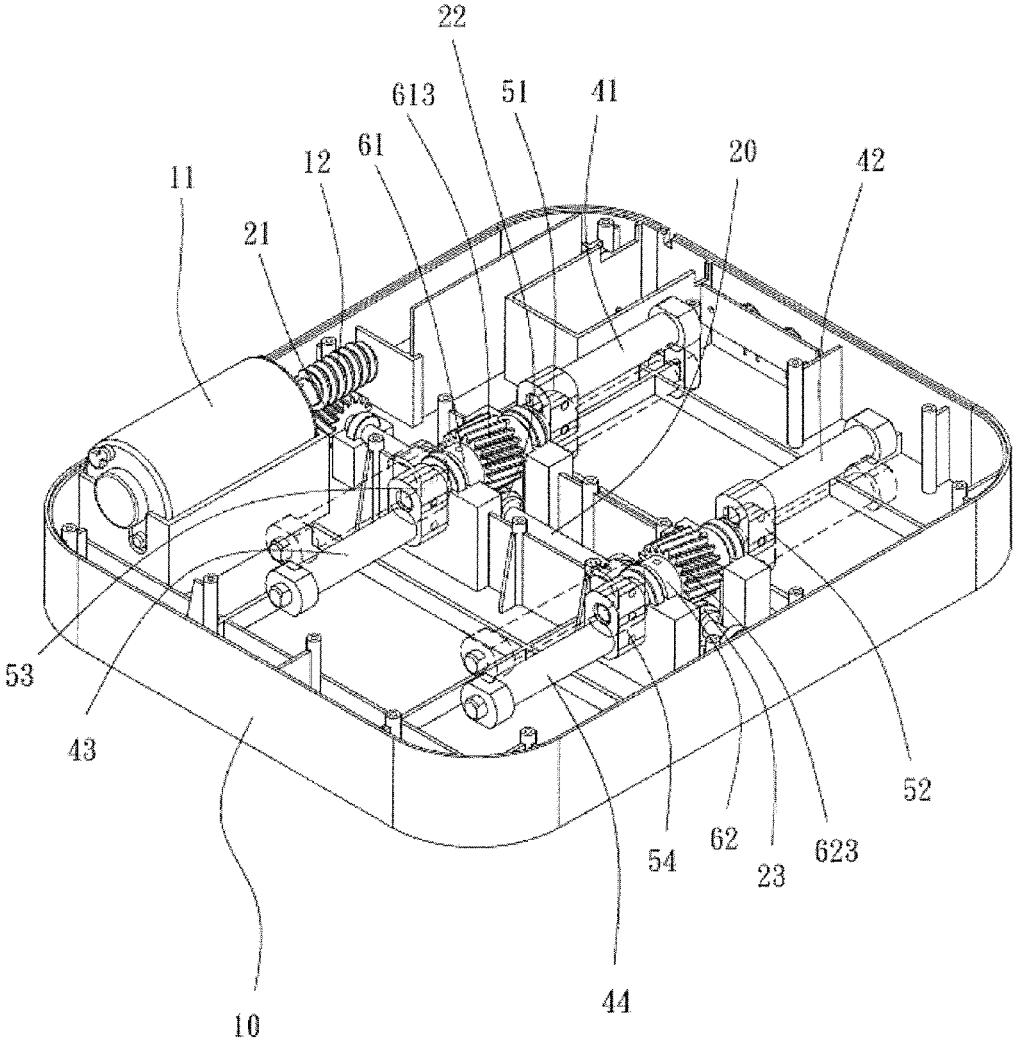
FIG. 3 is a cutaway view of rotation of spindles driven by the transmission-related elements of the fitness equipment of the present invention.
Figure 4:
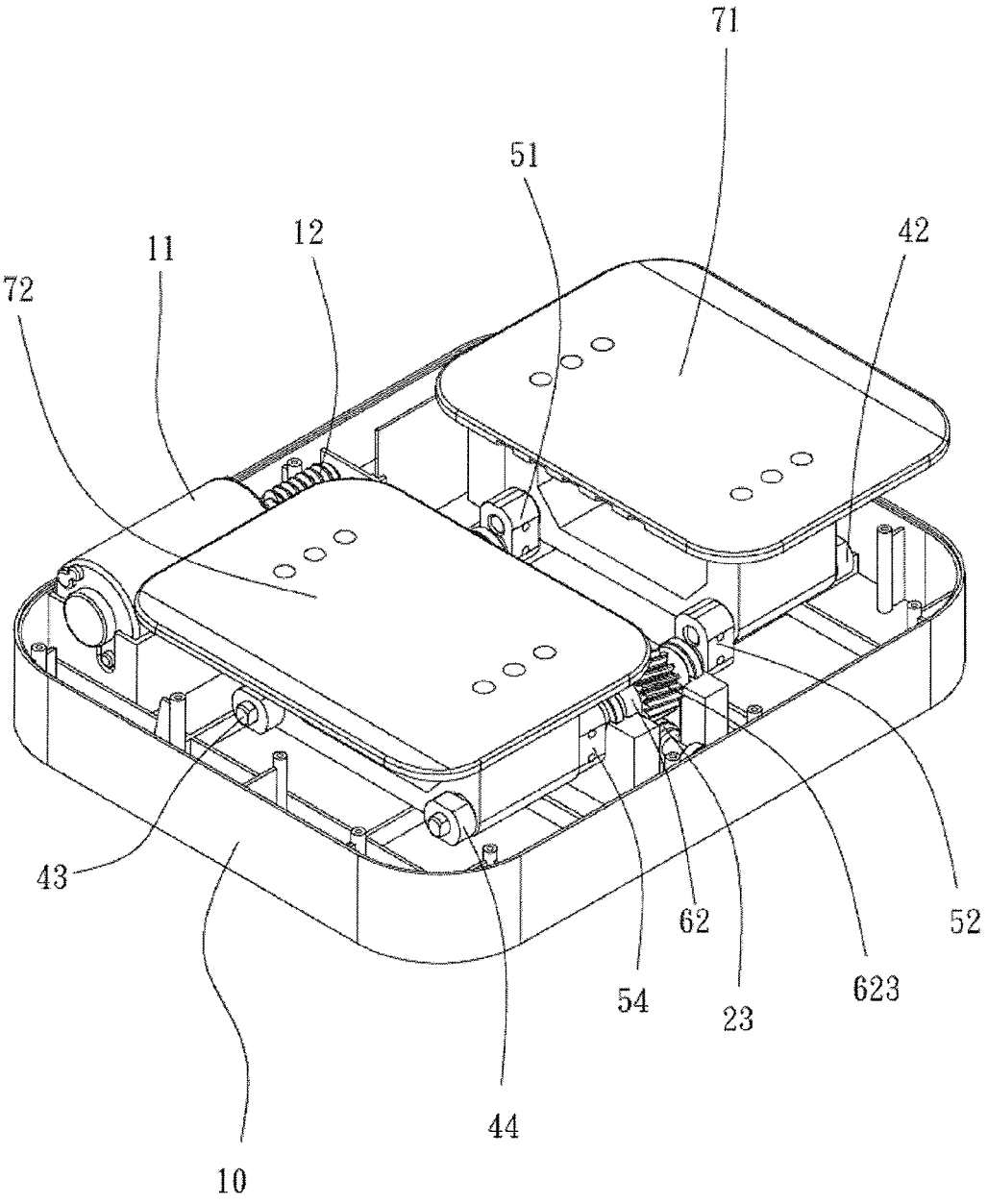
FIG. 4 is a perspective assembled view of the present invention U-shaped supports and rests according to an embodiment of the present invention.
Figure 5:
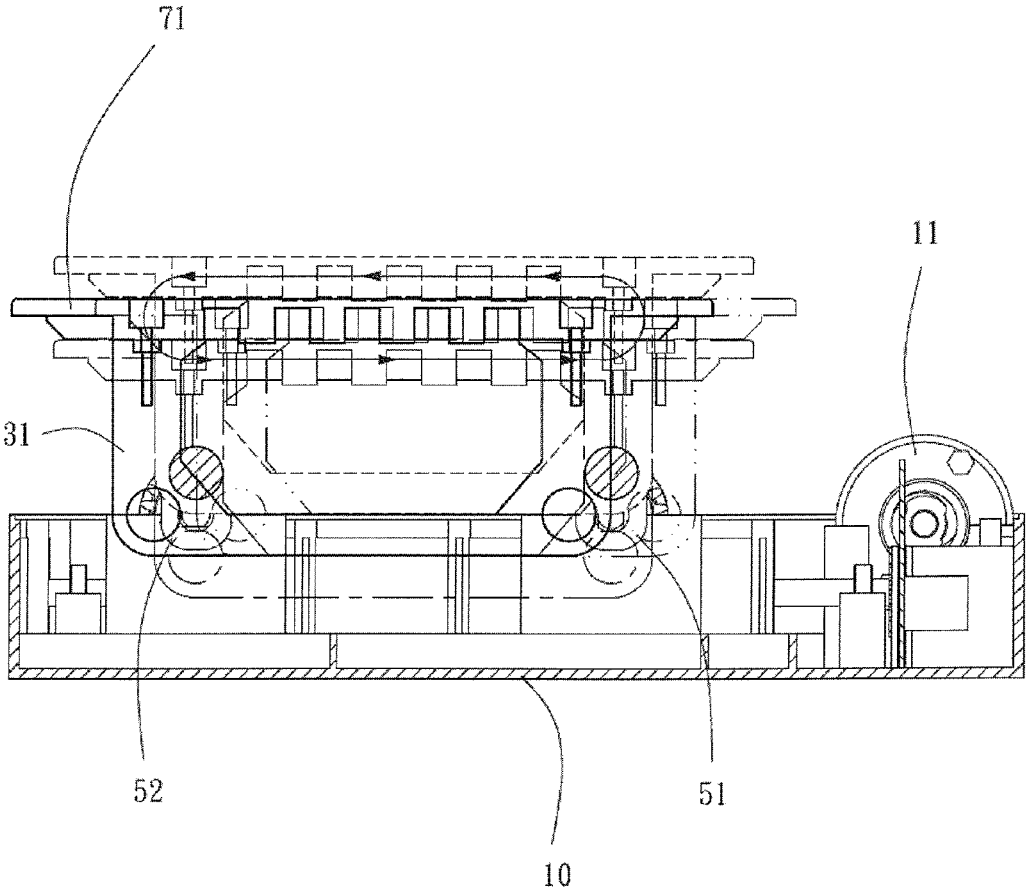
FIG. 5 is a schematic cross-sectional view of the fitness equipment according to an embodiment of the present invention.
Figure 6:
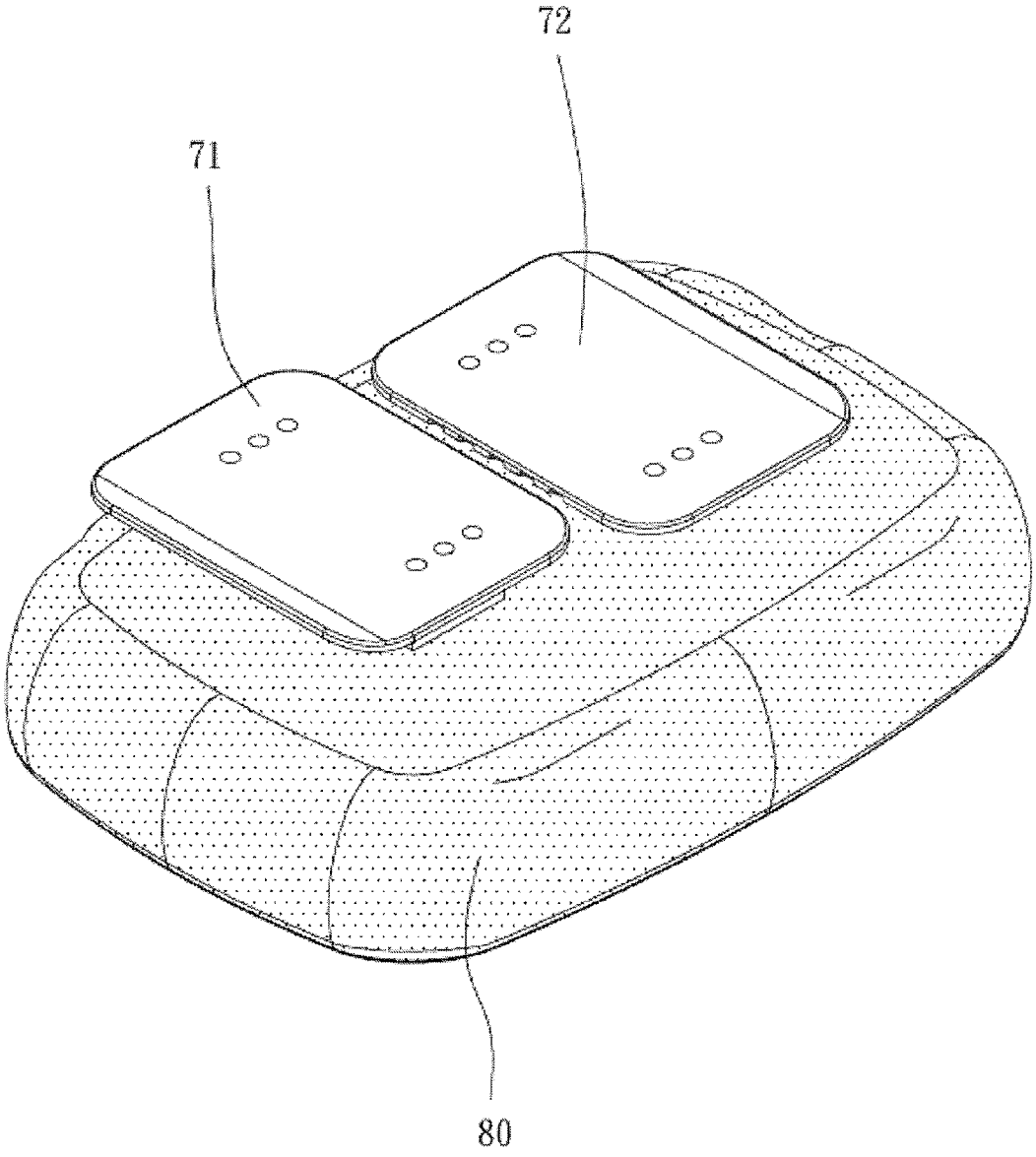
FIG. 6 is a perspective view of the fitness equipment, showing its casing enclosed by a sponge sleeve according to an embodiment of the present invention.
Figure 7:
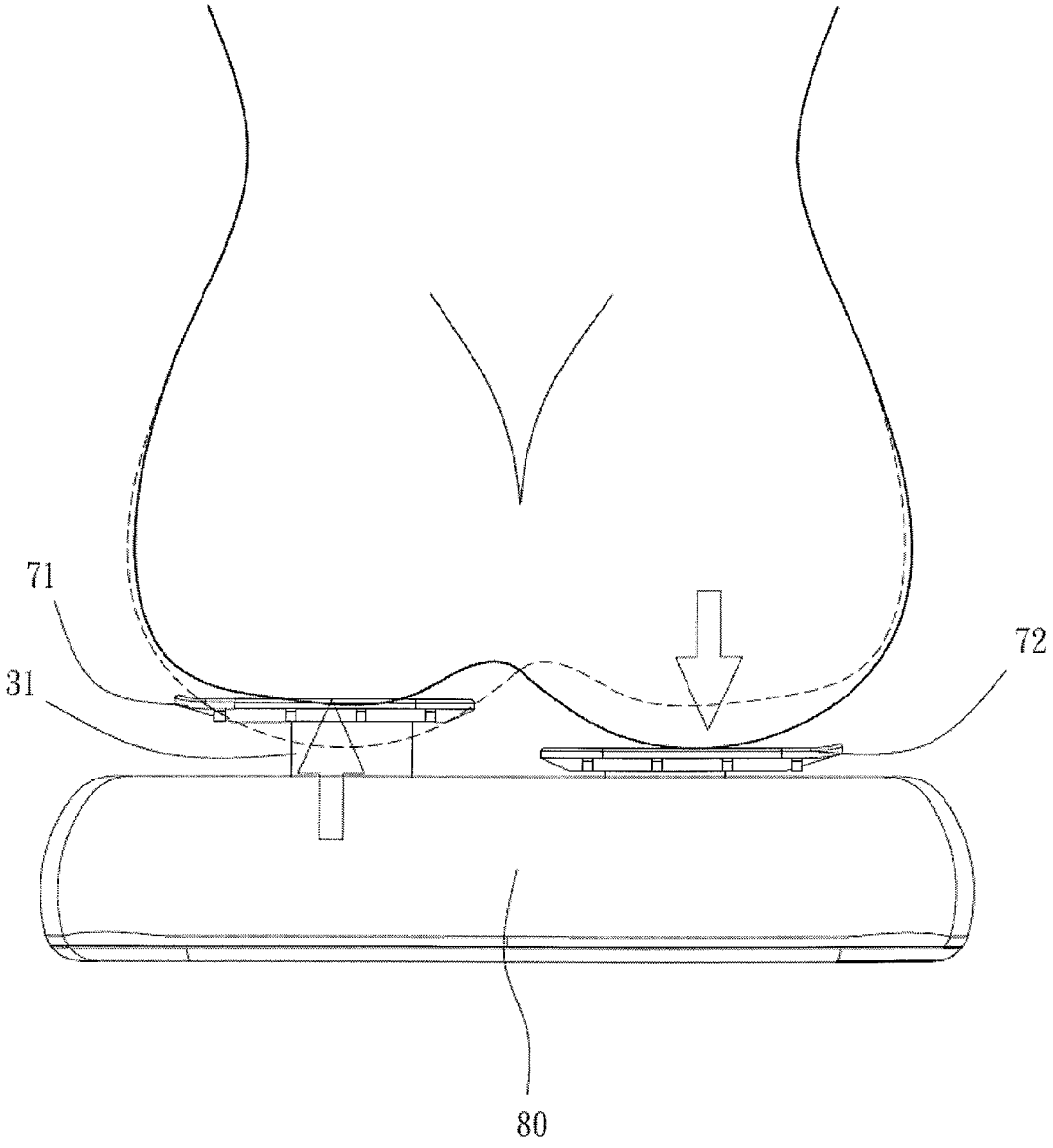
FIG. 7 is a schematic view of hip lift according to the present invention.
Figure 8:
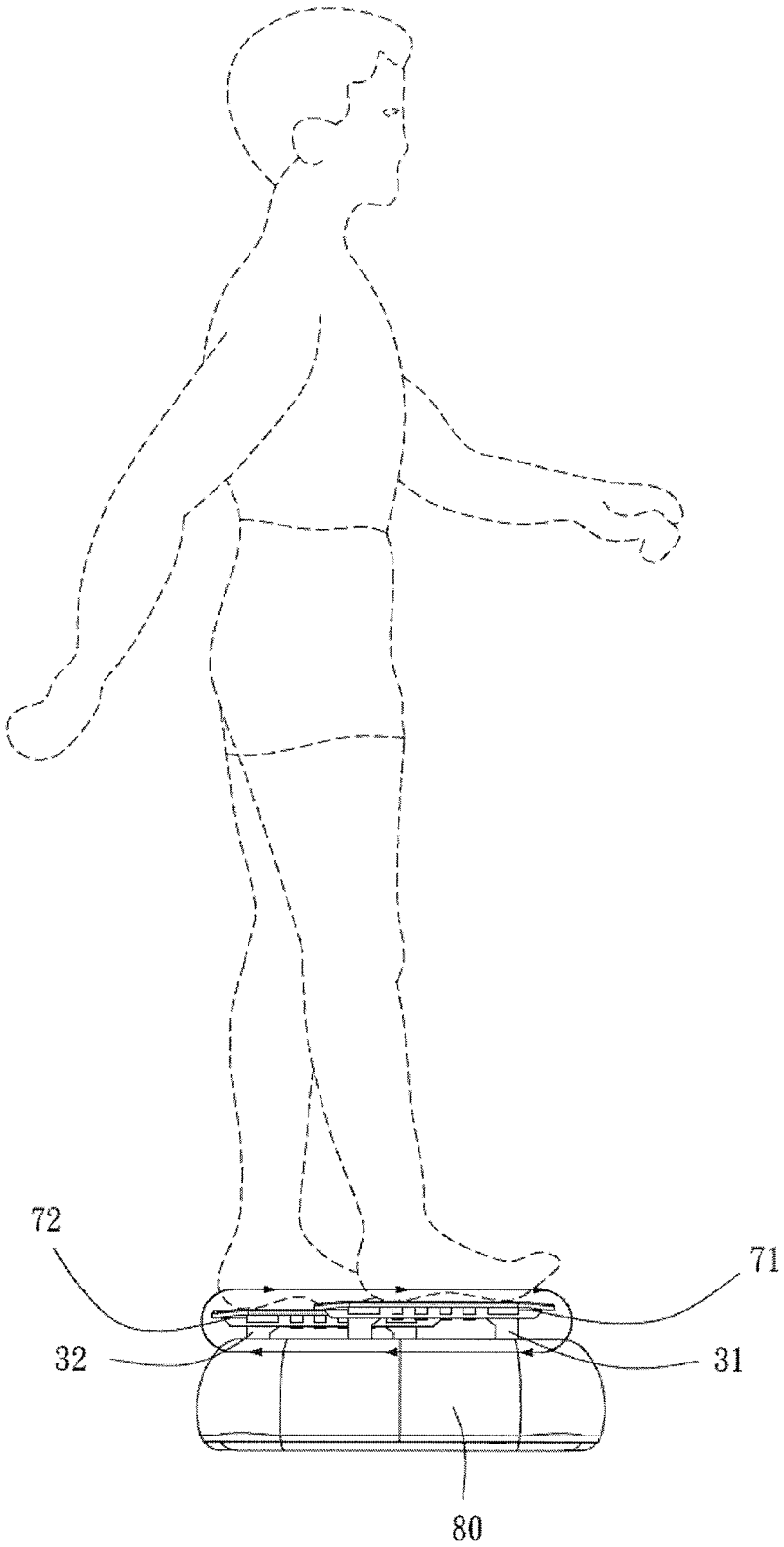
FIG. 8 is a schematic view of treading according to the present invention.

Referring to FIG. 1 through FIG. 8, the present invention provides a fitness equipment for use in hip lift and treading. The fitness equipment comprises a casing 10, a transmission shaft 20, a first U-shaped support 31, and a second U-shaped support 32.

The casing 10 has therein a power source. The power source is a motor 11. The motor 11 comprises a center axle 111 to which a first worm gear 12 is fixed.

The transmission shaft 20 is transversely and centrally disposed in the casing 10. The transmission shaft 20 is fixedly provided with a first gear 21, a second worm gear 22 and a third worm gear 23. The first gear 21 meshes with the first worm gear 12. The transmission shaft 20 is provided with and supported by a plurality of first bearings 24.

The first U-shaped support 31 has first and second through holes 311, 312. The first and second through holes 311, 312 are disposed on two sides of the bottom of the first U-shaped support 31, respectively. The first U-shaped support 31 is provided with a first spindle 41 and a second spindle 42. The first and second spindles 41, 42 each have one end provided with a first stop portion 411 and a second stop portion 421, respectively. The first spindle 41 has a first rod segment 412 which penetrates the first through hole 311, such that a first flat bar 413 disposed at the other end of the first spindle 41 is inserted into and fixed to a first lower eccentric hole 511 of a first eccentric block 51. A fifth flat bar 611 disposed at one end of a first independent shaft 61 oriented longitudinally is inserted into and fixed to a first upper eccentric hole 512 of the first eccentric block 51. The first independent shaft 61 is flanked and supported by two second bearings 612. The first independent shaft 61 is intermediately and fixedly provided with a second gear 613. The second gear 613 meshes with the second worm gear 22. The second spindle 42 has a second rod segment 422 which penetrates the second through hole 312, such that a second flat bar 423 disposed at the other end of the second spindle 42 is inserted into and fixed to a second lower eccentric hole 521 of a second eccentric block 52. A seventh flat bar 621 disposed at one end of a second independent shaft 62 oriented longitudinally is inserted into and fixed to a second upper eccentric hole 522 of the second eccentric block 52. The second independent shaft 62 is flanked and supported by two third bearings 622. The second independent shaft 62 is intermediately and fixedly provided with a third gear 623. The third gear 623 meshes with the third worm gear 23. The first U-shaped support 31 is disposed in the casing 10 and protrudes upward from a top surface of the casing 10. A first rest 71 is fixed to the top surface of the casing 10.

The second U-shaped support 32 has third and fourth through holes 321, 322. The third and fourth through holes 321, 322 are disposed on two sides of the bottom of the second U-shaped support 32, respectively. The second U-shaped support 32 is provided with a third spindle 43 and a fourth spindle 44. The third and fourth spindles 43, 44 each have one end provided with a third stop portion 431 and a fourth stop portion 441, respectively. The third spindle 43 has a third rod segment 432 which penetrates the third through hole 321, such that a third flat bar 433 disposed at the other end of the third spindle 43 is inserted into and fixed to a third upper eccentric hole 531 of a third eccentric block 53. A sixth flat bar 614 disposed at one end of the first independent shaft 61 oriented longitudinally is inserted into and fixed to a third lower eccentric hole 532 of the third eccentric block 53. A fourth rod segment 442 of the fourth spindle 44 penetrates the fourth through hole 322, such that a fourth flat bar 443 disposed at the other end of the fourth spindle 44 is inserted into and fixed to a fourth upper eccentric hole 541 of a fourth eccentric block 54. An eighth flat bar 624 disposed at one end of the second independent shaft 62 oriented longitudinally is inserted into and fixed to a fourth lower eccentric hole 542 of the fourth eccentric block 54. The second U-shaped support 32 is disposed in the casing 10 and protrudes upward from a top surface of the casing 10. A second rest 72 is fixed to the top surface of the casing 10.

Given the aforesaid elements and structures, the center axle 111 of the motor 11 rotates to drive the first and second independent shafts 61, 62 to rotate. The rotational mechanical energy of the first and second independent shafts 61, 62 is transmitted to the first, second, third and fourth eccentric blocks 51, 52, 53, 54, such that the first, second, third and fourth spindles 41, 42, 43, 44, the first and second U-shaped supports 31, 32, and the first and second rests 71, 72 together move vertically and alternately along an elliptic track so as for a user standing on the first and second rests 71, 72 to tread and for the user sitting on the first and second rests 71, 72 to lift the hips alternately.

As regards the fitness equipment for use in hip lift and treading, the casing 10 is enclosed by a sponge sleeve 80.

What is claimed is:

1. A fitness equipment for use in hip lift and treading, comprising:

a casing having therein a power source, the power source being a motor, the motor comprising a center axle to which a first worm gear is fixed;

a transmission shaft transversely and centrally disposed in the casing and fixedly provided with a first gear and at least a second worm gear, the first gear meshing with the first worm gear; and a first U-shaped support having at least a first through hole disposed at a bottom of the first U-shaped support and having at least a first spindle, the first spindle having an end provided with a first stop portion and having a first rod segment penetrating the first through hole, such that a first flat bar disposed at another end of the first spindle is inserted into and fixed to a first lower eccentric hole of at least a first eccentric block, wherein a fifth flat bar disposed at an end of at least a first independent shaft oriented longitudinally is inserted into and fixed to a first upper eccentric hole of the first eccentric block, the first independent shaft being intermediately and fixedly provided with a second gear, the second gear meshing with the second worm gear, the first U-shaped support being disposed in the casing and protruding upward from a top surface of the casing, wherein a first rest is fixed to the top surface of the casing, wherein the center axle of the motor rotates to drive the first independent shaft to rotate, allowing rotational mechanical energy of the first independent shaft to be transmitted to the first eccentric block, such that the first spindle, the first U-shaped support, and the first rest together move vertically and alternately along an elliptic track so as for a user standing on the first rest to tread and for the user sitting on the first rest to perform hip lift.

2. The fitness equipment of claim 1, wherein the transmission shaft has a third worm gear, wherein the first U-shaped support has the first through hole and a second through hole which are disposed on two sides of the bottom of the first U-shaped support, respectively, and has a second spindle, the second spindle having an end provided with a second stop portion and having a second rod segment penetrating the second through hole, such that a second flat bar disposed at another end of the second spindle is inserted into and fixed to a second lower eccentric hole of a second eccentric block, wherein a seventh flat bar disposed at an end of a second independent shaft oriented longitudinally is inserted into and fixed to a second upper eccentric hole of the second eccentric block, the second independent shaft being intermediately and fixedly provided with a third gear, the third gear meshing with the third worm gear.

3. The fitness equipment of claim 2, further comprising a second U-shaped support having third and fourth through holes disposed on two sides of a bottom of the second U-shaped support and having a third spindle and a fourth spindle, respectively, the third and fourth spindles each having an end provided with a third stop portion and a fourth stop portion, respectively, the third spindle having a third rod segment penetrating the third through hole, such that a third flat bar disposed at another end of the third spindle is inserted into and fixed to a third upper eccentric hole of a third eccentric block, wherein a sixth flat bar disposed at an end of the first independent shaft oriented longitudinally is inserted into and fixed to a third lower eccentric hole of the third eccentric block, the fourth spindle having a fourth rod segment penetrating the fourth through hole, such that a fourth flat bar disposed at another end of the fourth spindle is inserted into and fixed to a fourth upper eccentric hole of a fourth eccentric block, wherein an eighth flat bar disposed at an end of the second independent shaft oriented longitudinally is inserted into and fixed to a fourth lower eccentric hole of the fourth eccentric block, the second U-shaped support being disposed in the casing and protruding upward from a top surface of the casing, wherein a second rest is fixed to the top surface of the casing, wherein the center axle of the motor rotates to drive the first and second independent shafts to rotate, allowing rotational mechanical energy of the first and second independent shafts to be transmitted to the first, second, third and fourth eccentric blocks, such that the first, second, third and fourth spindles, the first and second U-shaped supports, and the first and second rests together move vertically and alternately along an elliptic track so as for a user standing on the first and second rests to tread and for the user sitting on the first and second rests to lift hips alternately.

4. The fitness equipment of claim 3, wherein the transmission shaft penetrates a plurality of first bearings for supporting the transmission shaft and enabling the transmission shaft to be fixed to the casing from inside.

5. The fitness equipment of claim 3, wherein the first independent shaft is flanked by two second bearings for supporting the first independent shaft and enabling the first independent shaft to be fixed to the casing from inside.

6. The fitness equipment of claim 3, wherein the second independent shaft is flanked by two third bearings for supporting the second independent shaft and enabling the second independent shaft to be fixed to the casing from inside.

7. The fitness equipment of claim 1, wherein the casing is enclosed by a sponge sleeve.

8. A fitness equipment for use in hip lift and treading, comprising:

a casing having therein a motor, the motor comprising a center axle to which a first worm gear is fixed;

a transmission shaft transversely and centrally disposed in the casing and fixedly provided with a first gear, a second worm gear and a third worm gear, the first gear meshing with the first worm gear;

a first U-shaped support having first and second through holes disposed on two sides of a bottom of the first U-shaped support and having a first spindle and a second spindle, respectively, the first and second spindles each having an end provided with a first stop portion and a second stop portion, respectively, the first spindle having a first rod segment penetrating the first through hole, such that a first flat bar disposed at another end of the first spindle is inserted into and fixed to a first lower eccentric hole of a first eccentric block, wherein a fifth flat bar disposed at an end of a first independent shaft oriented longitudinally is inserted into and fixed to a first upper eccentric hole of the first eccentric block, the first independent shaft being intermediately and fixedly provided with a second gear, the second gear meshing with the second worm gear, the second spindle having a second rod segment penetrating the second through hole, such that a second flat bar disposed at another end of the second spindle is inserted into and fixed to a second lower eccentric hole of a second eccentric block, wherein a seventh flat bar disposed at an end of a second independent shaft oriented longitudinally is inserted into and fixed to a second upper eccentric hole of the second eccentric block, the second independent shaft being intermediately and fixedly provided with a third gear, the third gear meshing with the third worm gear, the first U-shaped support being disposed in the casing and protruding upward from a top surface of the casing, wherein a first rest is fixed to the top surface of the casing; and a second U-shaped support having third and fourth through holes disposed on two sides of a bottom of the second U-shaped support and having a third spindle and a fourth spindle, respectively, the third and fourth spindles each having an end provided with a third stop portion and a fourth stop portion, respectively, the third spindle having a third rod segment penetrating the third through hole, such that a third flat bar disposed at another end of the third spindle is inserted into and fixed to a third upper eccentric hole of a third eccentric block, wherein a sixth flat bar disposed at an end of the first independent shaft oriented longitudinally is inserted into and fixed to a third lower eccentric hole of the third eccentric block, the fourth spindle having a fourth rod segment penetrating the fourth through hole, such that a fourth flat bar disposed at another end of the fourth spindle is inserted into and fixed to a fourth upper eccentric hole of a fourth eccentric block, wherein an eighth flat bar disposed at an end of the second independent shaft oriented longitudinally is inserted into and fixed to a fourth lower eccentric hole of the fourth eccentric block, the second U-shaped support being disposed in the casing and protruding upward from a top surface of the casing, wherein a second rest is fixed to the top surface of the casing, wherein the center axle of the motor rotates to drive the first and second independent shafts to rotate, allowing rotational mechanical energy of the first and second independent shafts to be transmitted to the first, second, third and fourth eccentric blocks, such that the first, second, third and fourth spindles, the first and second U-shaped supports, and the first and second rests together move vertically and alternately along an elliptic track so as for a user standing on the first and second rests to tread and for the user sitting on the first and second rests to perform hip lift alternately.

9. The fitness equipment of claim 8, wherein the transmission shaft penetrates a plurality of first bearings for supporting the transmission shaft and enabling the transmission shaft to be fixed to the casing from inside.

10. The fitness equipment of claim 8, wherein the first independent shaft is flanked by two second bearings for supporting the first independent shaft and enabling the first independent shaft to be fixed to the casing from inside.

11. The fitness equipment of claim 8, wherein the second independent shaft is flanked by two third bearings for supporting the second independent shaft and enabling the second independent shaft to be fixed to the casing from inside.

12. The fitness equipment of claim 8, wherein the casing is enclosed by a sponge sleeve.

* * * * *